United States Patent [19]

Booker

[11] Patent Number: 4,544,322

[45] Date of Patent: Oct. 1, 1985

[54] SHIPS PROPULSION SHAFT REMOVAL APPARATUS

[76] Inventor: Arthur J. Booker, Rte. 1, Box 73, Zuni, Va. 23848

[21] Appl. No.: 493,078

[22] Filed: May 9, 1983

Related U.S. Application Data

[63] Continuation-in-part of Ser. No. 300,591, Sep. 9, 1981, Pat. No. 4,400,133.

[51] Int. Cl.[4] ..... B63B 3/00

[52] U.S. Cl. ..... 414/589; 414/401; 414/541; 414/584; 114/65 R

[58] Field of Search ..... 414/589, 590, 540, 541, 414/542, 495, 496, 401, 584, 396, 477, 746, 747, 10, 12, 911; 114/270, 222, 65 R

[56] References Cited

U.S. PATENT DOCUMENTS

| | | | |
|---|---|---|---|
| 2,896,909 | 7/1959 | Taylor | 414/589 X |
| 3,121,499 | 2/1964 | LaBarre, Jr. | 414/590 X |
| 3,204,525 | 9/1965 | Legg et al. | 414/749 |
| 3,486,653 | 12/1969 | Alstedt | 414/749 X |
| 3,524,556 | 8/1979 | Miller | 414/589 |
| 3,950,913 | 4/1976 | Mori | 414/12 X |
| 4,400,133 | 8/1983 | Booker | 414/589 |
| 4,440,265 | 4/1984 | Spagnoli | 414/589 X |
| 4,447,186 | 5/1984 | Renfro et al. | 414/589 |
| 4,461,455 | 7/1984 | Mills et al. | 414/589 X |

FOREIGN PATENT DOCUMENTS

| | | | |
|---|---|---|---|
| 468879 | 7/1975 | U.S.S.R. | 414/589 |

*Primary Examiner*—Terrance L. Siemens

*Attorney, Agent, or Firm*—Wilkinson, Mawhinney & Theibault

[57] ABSTRACT

The present disclosure is directed to an apparatus for removing or replacing a ships underwater propulsion shaft in a dry dock and transporting it from the ship to a work area. It has a mobile vehicular frame and a pair of spaced apart main cylinder ram lifts pivoted at their base to the vehicular frame, each lying beneath a primary and secondary shaft support for carrying the shaft to be removed. The shaft receiving and removing means is mounted at the upper ends of said main cylinder ram lifts. Auxiliary tilt cylinder and ram means each having one end pivoted to said vehicular frame and the other end pivotally connected to tilt the main cylinder and ram lifts toward and away from the ships part to be removed from or replaced on the ship. Hydraulic units are carried by said vehicular frame for raising and lowering the vehicular frame upwardly toward and downwardly away from the ship and hydraulic units for longitudinally shifting said vehicular frame forwardly or rearwardly along the major axis of the ship are provided to align the shaft receiving means with the vehicle and to remove it.

11 Claims, 10 Drawing Figures

SHIPS PROPULSION SHAFT REMOVAL APPARATUS

This application is a continuation-in-part of Ser. No. 300,591, filed Sept. 9, 1981, now U.S. Pat. No. 4,400,133.

TECHNICAL FIELD

The present disclosure is directed to an apparatus for working in a dry dock to remove large heavy ships propulsion shafts varying between 35 to 70 ft. in length and weighing from 30 to 65 tons. It is a mobile vehicular device having a pair of main vertical free ends of the main lift rams, and auxiliary tilt cylinders connected between the vehicular frame and the main lift rams having a primary shaft support secured to the upper end of the main ram lifts which carries a plurality of individually vertically elevatable and individually horizontally transportable dollys movable along the primary shaft support for receiving and removing the propulsion shaft from the stern tube of the ships hull to transport it to a work area.

BACKGROUND ART

Heretofore apparatus has been devised to raise and lower heavy objects and to give compound motions such as while moving in one direction a second device carried by the first may move at a right angle thereto; however, I am not aware of apparatus of the type shown and described herein for handling ships propulsion shafts prior to my invention. The best art known to me at the filing of this application for Letters Patent are U.S. Pat. 2,896,909
U.S. Pat. 3,486,653

DISCLOSURE OF THE INVENTION

In accordance with my invention I provide an apparatus for removing or replacing a ships propulsion shaft from a ships hull in a dry dock for transporting it to a work area. This structure is a mobile vehicular frame which may be driven in the dry dock and positioned beneath the propulsion shaft to be removed. Carried by the vehicular frame is a primary shaft support means which is elevatable toward and away from the shaft to be removed. At least a pair of secondary shaft dolly supports are carried by the primary support and each are movable independently of the other along the primary support and each carries a hydraulic jack variable shaft alignment positioning means for receiving and supporting the shaft as it is withdrawn from the stern tube so that it does not bind incident to any droop or sag of the shaft due to its weight between the shaft support points. In the preferred embodiment three dolly supports with shaft receiving means mounted on the hydraulic jacks are employed to engage and progressively remove the shaft from the stern tube the dollys being positioned at spaced intervals to avoid shaft sag and binding. The primary support is raised and lowered to give a rough adjustment for shaft and dolly alignment while the hydraulic jacks provide vernier or precise minute alignment to avoid binding of the shaft in the stern tube bearings. The vehicle carrying the primary shaft support may also be movable up/down or left/-right of the shaft axis to provide a great range of varying the angle of shaft extraction to eliminate any binding of the shaft during its removal.

THE BEST MODE FOR CARRYING OUT THE INVENTION

The apparatus of this application is for use with the vehicle frame illustrated in my co-pending application Ser. No. 300,591, filed Sept. 9, 1981, now U.S. Pat. No. 4,400,133.

Figure 2:
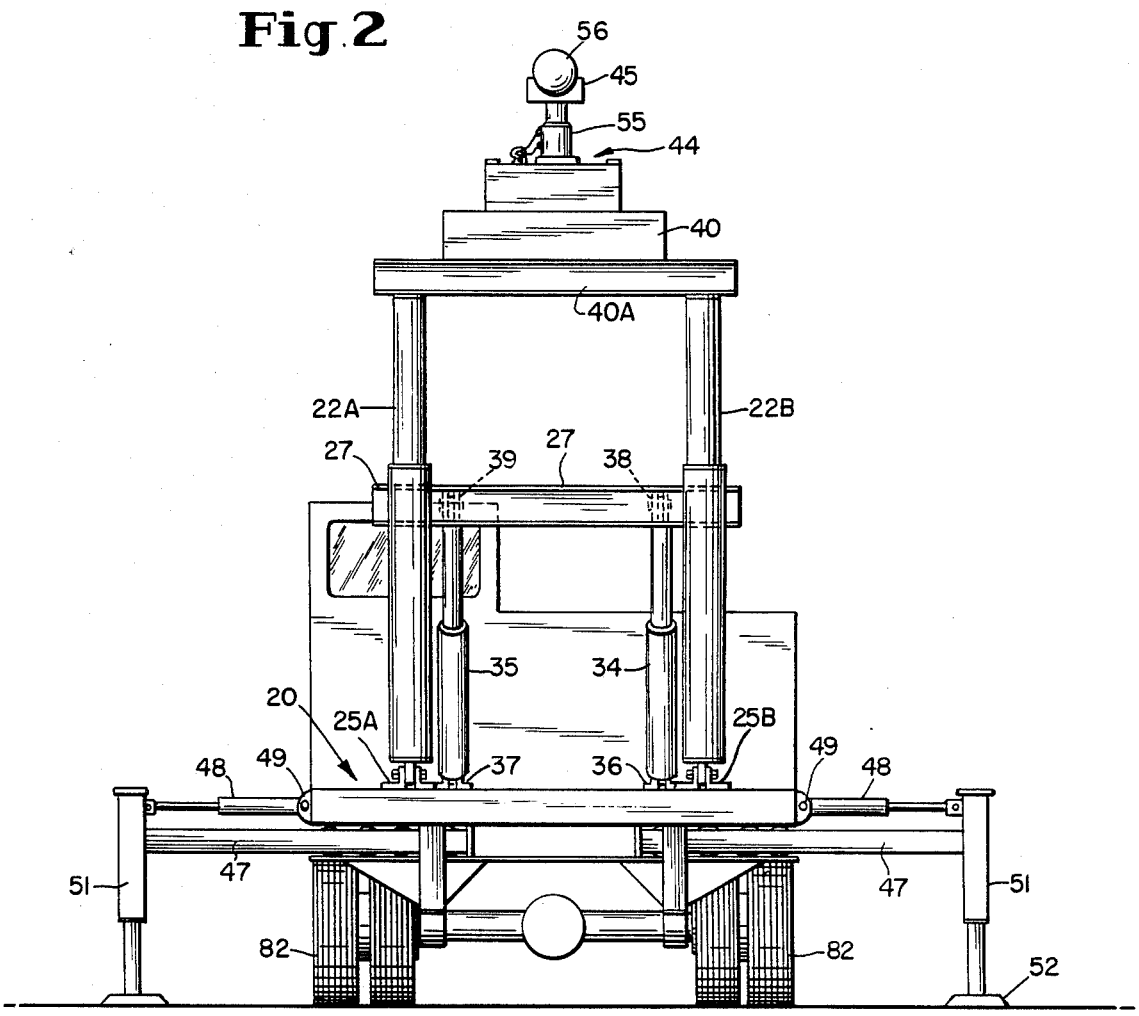
FIG. 2 is a vertical rear elevation of the apparatus or FIG. 1 taken on the line 2—2 in FIG. 1.
Figure 3:
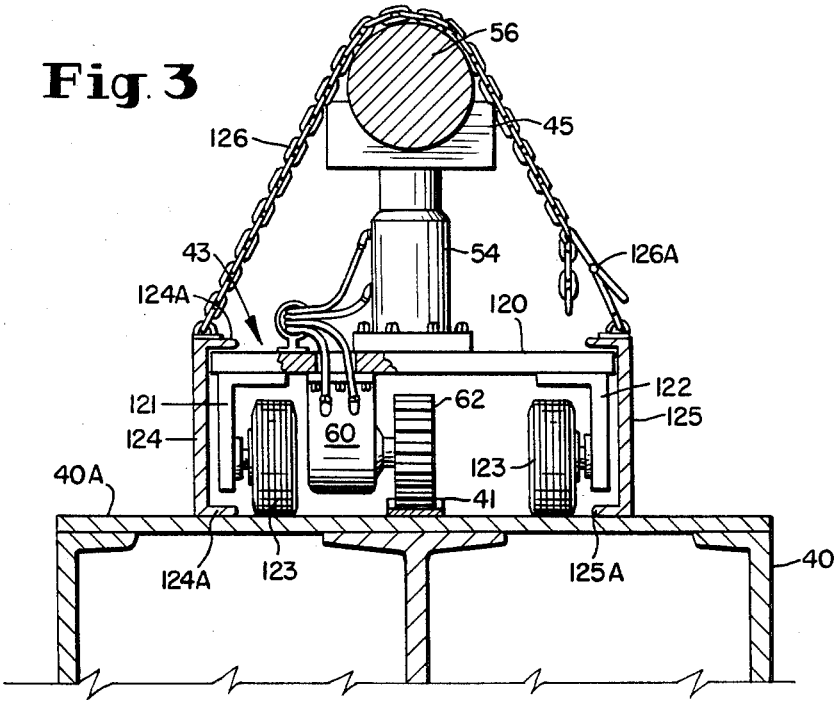
FIG. 3 is an enlarged view taken on the line 3—3 in FIG. 1 showing the apparatus of the present invention with the propulsion shaft of FIG. 1 in place.
Figure 4:
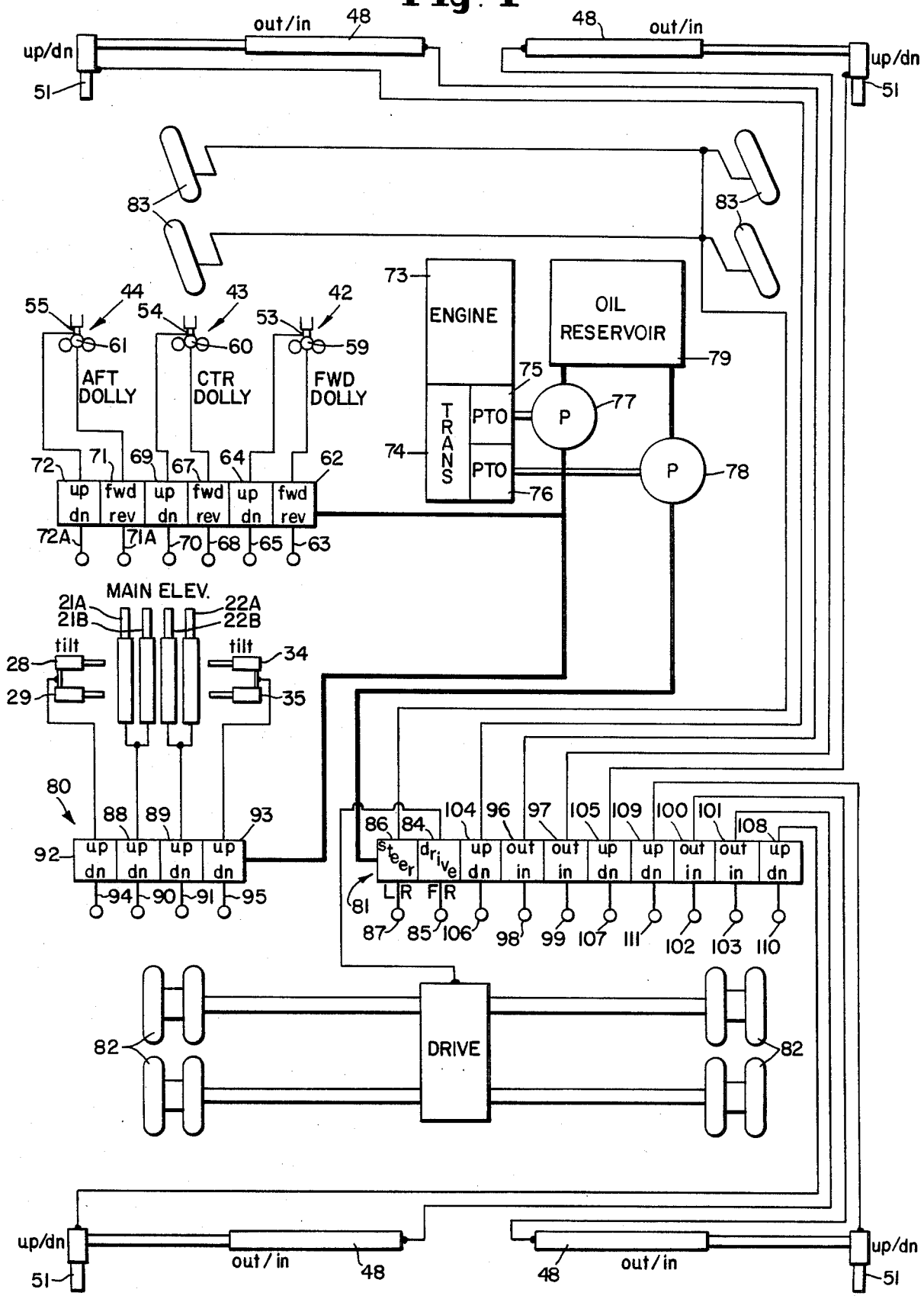
FIG. 4 is a hydraulic schematic of the apparatus of FIGS. 1 through 3.
Figure 5:
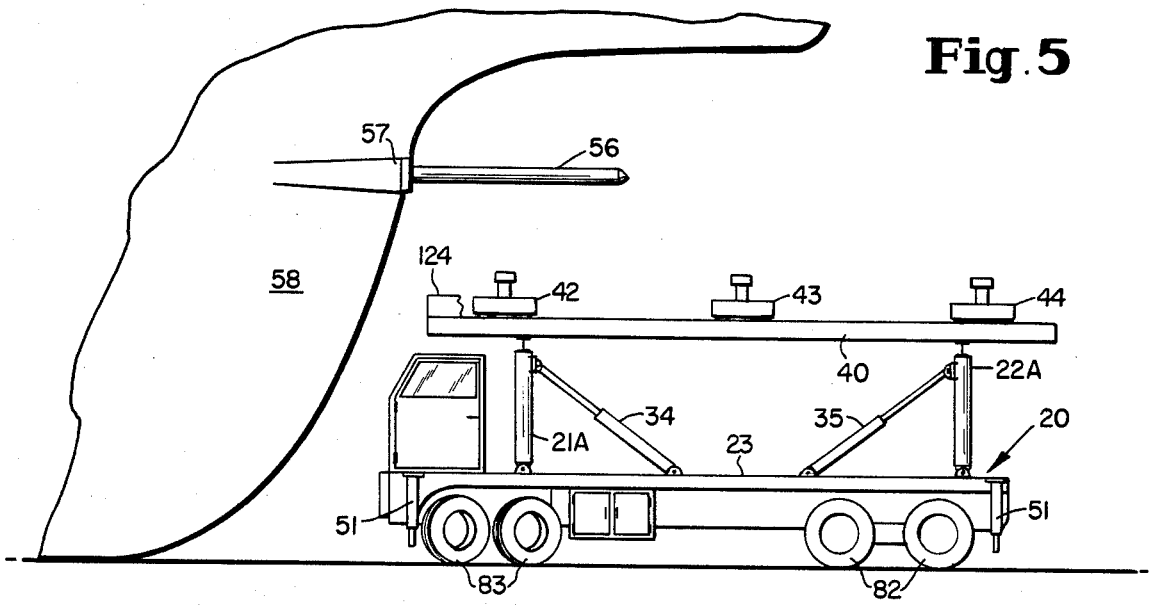
FIG. 5 is a side elevational view of the apparatus of the present invention shown approaching a propulsion shaft whose screw has been removed preparatory to removal of the shaft from the ships hull.
Figure 6:
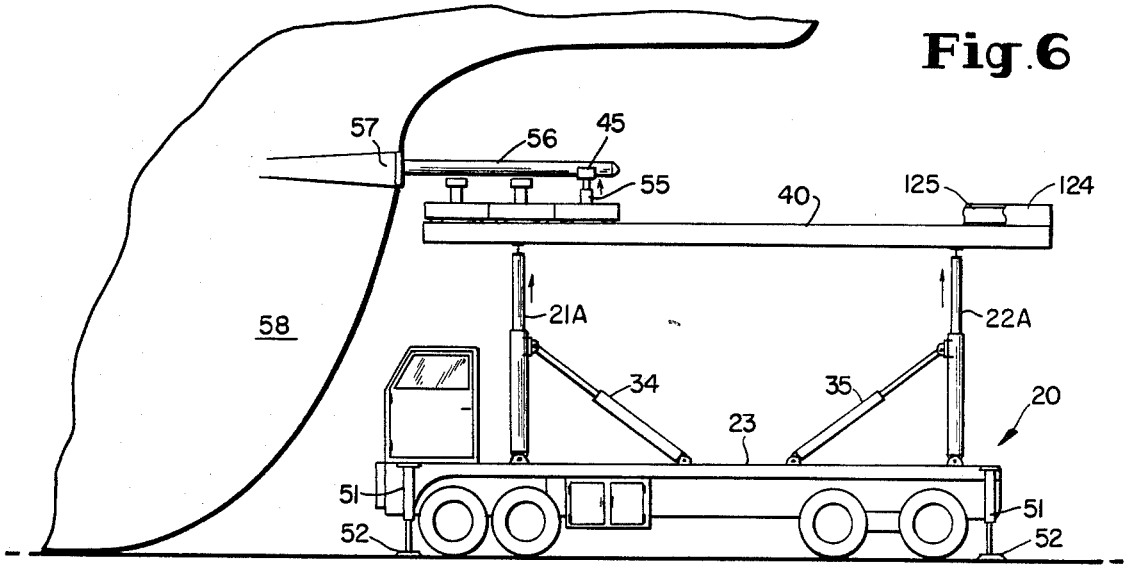
FIG. 6 is a side elevational view of the apparatus of FIG. 5 with the secondary shaft dolly supports positioned at the forward end of the primary shaft support commencing shaft removal from the hull.
Figure 7:
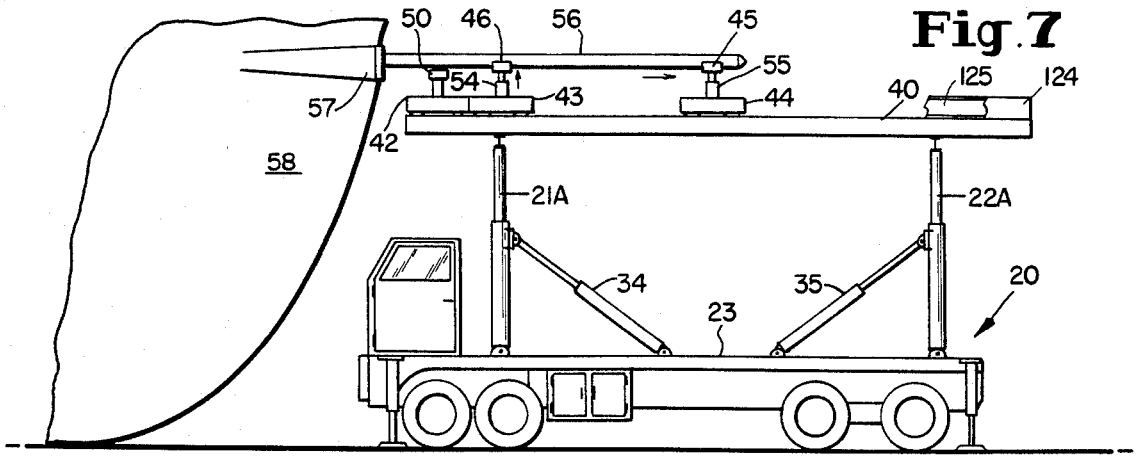
FIG. 7 is a side elevational view of the apparatus of FIGS. 5 and 6 in an intermediate stage of shaft removal from the hull.

Referring now to FIGS. 1 through 3, 20 designates a mobile vehicular frame of the self-propelled type, see FIG. 4, having pairs of spaced apart main cylinder-ram lifts 21A, 21B, 22A, 22B pivoted to a base structure 23 at 24A, 24B, 25A, 25B respectively. Each cylinder 21A, 21B, 22A, 22B has a beam 26, 27 welded or otherwise secured thereto. A pair of auxiliary tilt cylinder and ram units 28, 29 have one end pivotally connected to the base structure 23 at 30, 31 and the other end pivotally connected to the beam 26 at 32, 33 while an identical pair of auxiliary tilt cylinders 34, 35 each have one end pivotally connected to the base structure 23 at 36, 37 and their other end is pivotally connected to the beam 27 at 38, 39.

Figure 1:
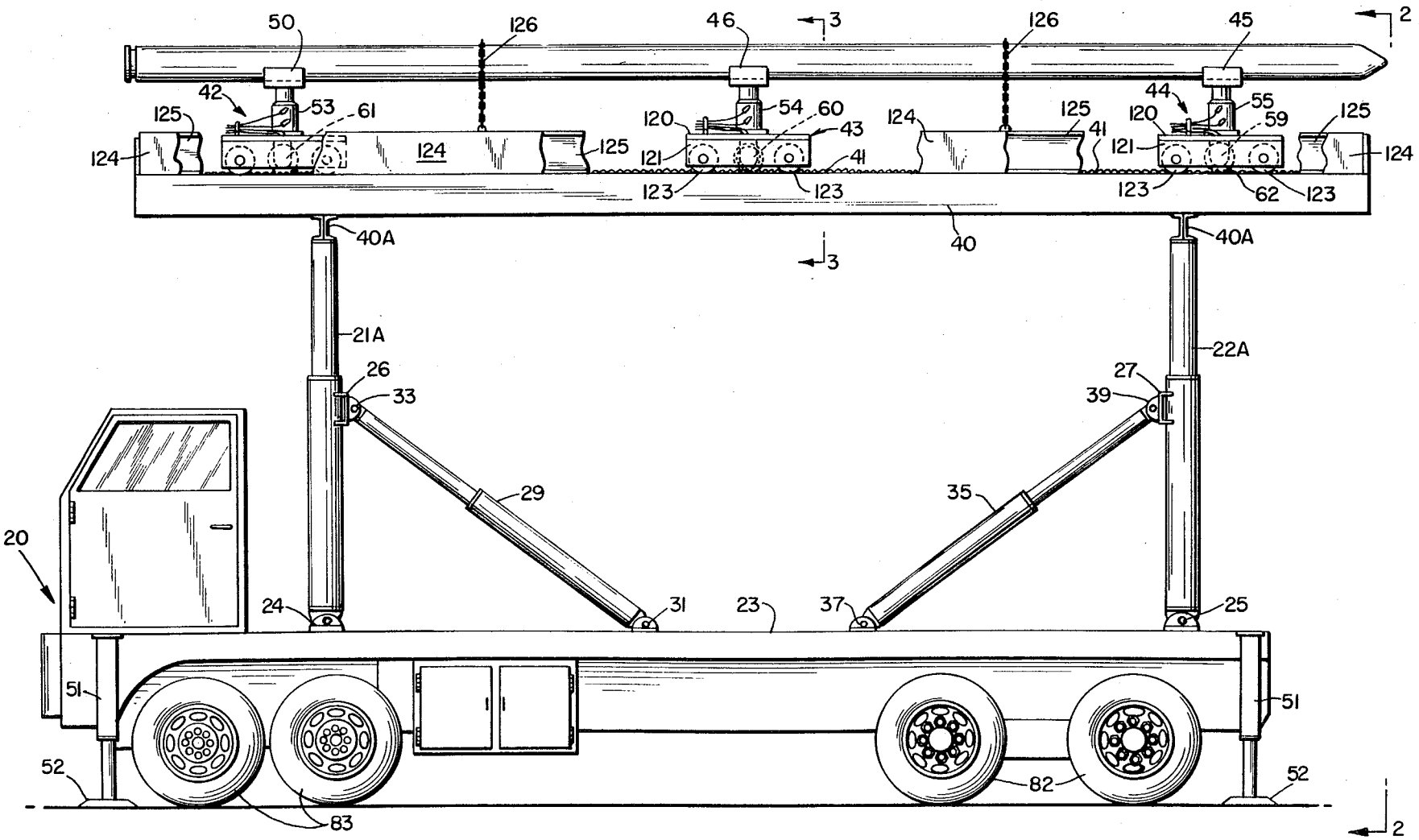
FIG. 1 is a side elevational view of the apparatus of the present invention carrying a propulsion shaft removed from a ships hull.

A primary shaft support 40 is mounted on the upper ends of the main cylinder-ram lifts 21A, 21B, 22A, 22B on support beams 40A. The support 40 carries a gear rack 41. Movable along the top of the support as best seen in FIGS. 1 and 3 are three secondary shaft dolly support means 42, 43 and 44, each being movable independently of the other. There are three propulsion shaft receiving means 45, 46 and 50, one carried by each dolly. Positioned between each shaft receiving means 45, 46 and 50, and each dolly are hydraulic lift jacks 53, 54 and 55, to maintain alignment and free sliding movement between the propulsion shaft 56 and the stern tube 57 of the ships hull 58 during removal of the shaft.

Each dolly 42, 43 and 44 is driven by a reversible hydraulic motor 59, 60 and 61, each of which drives a pinion 62 in mesh with the gear rack 41 of the primary support 40.

FIG. 3 being a view taken transversely through a dolly, all dollys being contructed identically shows that each has a top plate 120 having support angles 121, 122 on which are journalled rollers 123, there being four rollers for each dolly. Channel guides 124, 125 are secured to the top 40A of the primary shaft support means 40 with their flanges 124A and 125A directed inwardly so as to partially overlie the top plate 120 of the dolly so that with the shaft 56 in place on the shaft receiving means the dolly incident to transport vehicle motion while in motion the dolly cannot be tilted or rocked causing the shaft 56 to become disengaged or free of the shaft cradle 45. To further assure that the shaft 56 does not leave the cradle 45 adjustable teathering chains 126 secured to one end to channel guide 124 and at the other end to channel guide 125 with an adjustable locking link 126 therebetween. A plurality of these adjustable teathering chains may be spaced along the channels 124, 125 to either overlie the shaft receiving means of each dolly or to pass over the shaft 56 between each of the dollys during vehicle transport while carrying the shaft.

Referring now to FIG. 2, 47 designates a plurality of telescopically hydraulic extensible support members which are extended by hydraulic cylinder and ram units 48 which extend the support members or retract them toward the vehicle base structure 23. While the cylinder and ram units 48 are shown pivotally connected externally of the base structure at 49 they may be mounted beneath the base structure 23 to bring the support members closer to the base 23 to reduce transverse width of the vehicle for over the road transport. The support members 47 have rollers mounted on bearings, to support the weight of the vehicle on the members 47 and to permit moving or shifting the base 23 and its topside structure under action of the cylinder and ram units 48 when the entire vehicle structure is elevated clear of the ground or bottom of the dry dock. This structure is for shifting the vehicular structure 23 side-to-side along the major axis of the ship to align the shaft receiving means with the shaft and to move the shaft rearwardly of the ships hull after it has been disconnected therefrom.

Still referring to FIG. 2, the means carried by the vehicular frame for raising and lowering the vehicular frame clear of the ground, toward and away from the ship are a plurality of cylinder and ram units 51, the cylinder of which is rigidly secured to the extensible members 47 and the ram of which has load bearing transfer pads 52 for solid contact with the bottom of the dry dock or ground. With the extensible members 47 extended the cylinder units 51 activated to push the rams downwardly so that the pads 52 engage the ground, the vehicular frame may be elevated to permit it to be moved to the right or left in FIG. 2 to remove the propulsion shaft 56 after the screw has been removed.

Referring now to FIG. 4, the motive power and control system for the present invention is shown. The prime mover 73 is an engine of either the gasoline or diesel type having a transmission 74 and two power take offs 75, 76 which drive hydraulic pumps 77, 78 which receive hydraulic oil from a sump 79. Each pump 77, 78 supplies a valve control manifold 80, 81 plus the manifold controlling the three dollies.

The propulsion and steering mechanism controls the rear traction wheels 82 and the front steering wheels 83. Valve 84 under control of lever 85 controls moving the vehicle forward and reverse while valve 86 under control of lever 87 steers the vehicle either left or right.

The main cylinder and ram lifts 21A, 21B, 22A, 22B are connected each pair in parallel and are controlled by valves 88, 89 operated by levers 90, 91 respectively.

The auxiliary tilt cylinder 28, 29 and 34, 35 for main lift rams 21A, 21B, 22A, 22B are controlled by valves 92, 93 under control of levers 94, 95.

The cylinder and ram units 48 for extending the extensible support members 47 for shifting the vehicular frame 20 side-to-side along the axis of the shaft 56 are controlled by valves 96, 97 under control of levers 98, 99 for the forward members while valves 100, 101 under control of levers 102, 103 control the extension of the aft members 47.

The cylinder and ram units 51 for raising and lowering the vehicular frame upwardly toward or downwardly away from the ships shaft 56 are controlled by valves 104, 105 under control of levers 106, 107 for the forward units 51 while valves 108, 109 under control of levers 110, 111 control the aft lift units 51.

In the embodiment illustrated the dolly drives and the lift jacks are hydraulically actuated. The forward dolly 42 has its motion back and forth along gear rack 41 controlled by valve 62 actuated by lever 63. The jack 53 on dolly 42 is raised and lowered by valve 64 actuated by lever 65.

The center dolly 43 has its motion back and forth along gear rack 41 controlled by valve 67 actuated by lever 68. The jack 54 on dolly 43 is raised and lowered by valve 69 actuated by lever 70.

The aft dolly 44 has its motion back and forth along gear rack 41 controlled by valve 71 actuated by lever 71A. The jack 55 on dolly 44 is raised and lowered by valve 72 actuated by lever 72A.

Figure 8:
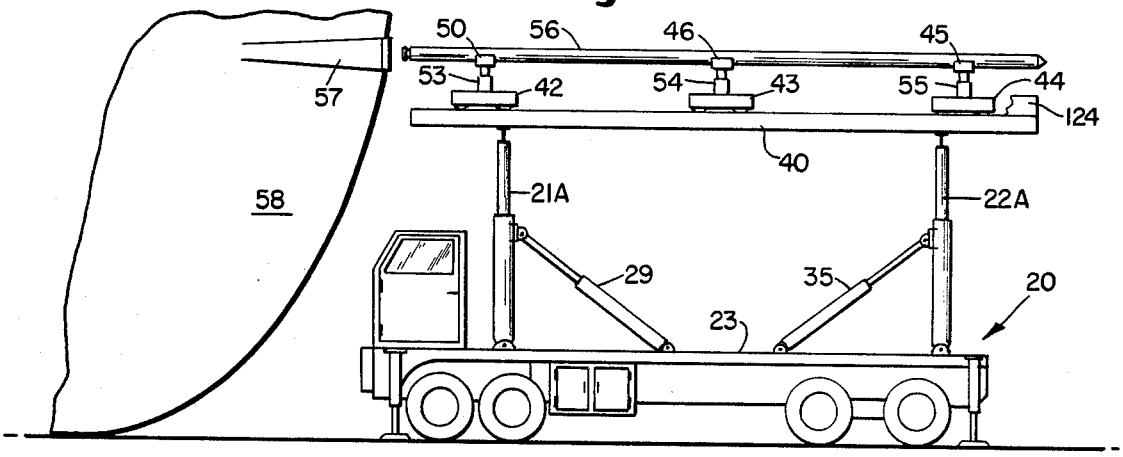
FIG. 8 is a side elevational view of the apparatus of FIGS. 5 through 7 showing the propulsion shaft removed.
Figure 9:
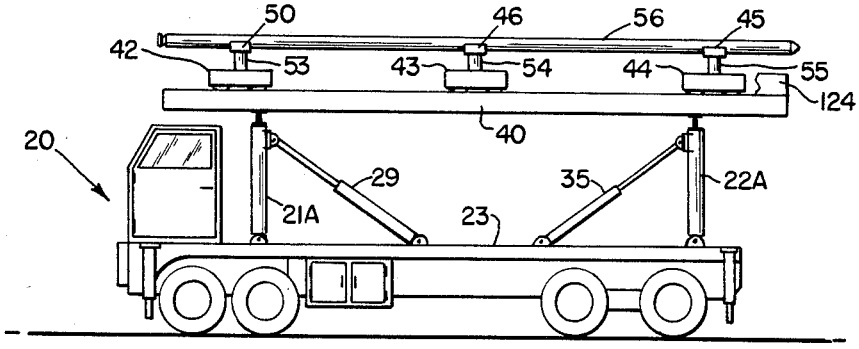
FIG. 9 is a side elevational view of the apparatus of FIGS. 5 through 8 with the primary shaft support means lowered away from the hull with the shaft thereon ready for transport to a work area.

Referring now to FIGS. 5 through 8, the sequence of shaft removal is shown wherein the vehicle approaches the stern of the vessel with the shaft support 40 and its three dollys in the lowered position. The stabilizing ram units 51 are then set. The cylinder ram lifts 21A, 21B, 22A, 22B then raise the support 40 to the position of FIG. 6 with all three dollys at the forward end of support 40. The jack 55 on the aft dolly 44 is raised to take the weight of propulsion shaft 56. The dolly then moves with the shaft 56 to the position of FIG. 7 at which time jack 45 on dolly 43 is raised to place shaft weight on the dollys 44 and 43. As shown in FIG. 8 dollys 42, 43 and 44 totally supported thereon clear of the ships hull 58. The primary shaft support 40 is then lowered to the transport conditon of FIG. 9, the ground stabilizers 51 elevated and the vehicle transports the propulsion shaft 56 to the work area. The raising and lowering of the jacks 53, 54 and 55 while advancing the dollys along the support 40 will assure that the shaft 56 will not bind or lock in the stern tube 57 as it is being axially withdrawn due to shaft weight causing a flexing action which could tend to bind the shaft in the stern tube 57 and resist withdrawal therefrom.

To return the shaft to the hull 58 the reverse procedure is employed. The vehicle with the reworked shaft in the shaft receiving means 45, 46 and 50 is brought back to the hull 58, the support 40 elevated to align the shaft 56 with the stern tube 57 and the dollys then move to the left feeding the shaft into the stern tube 57 until it is coupled to the ships drive system then the support 40 is lowered and the vehicle removed.

Figure 10:
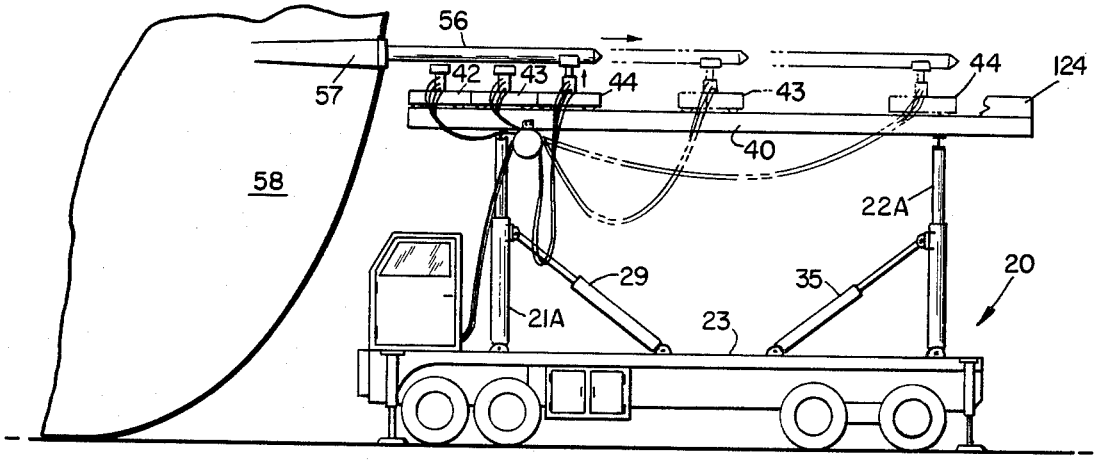
FIG. 10 is a schematic view of the hydraulic connections between the controls, dolly shaft supports and hydraulic sump showing the hydraulic lines in the position of FIG. 6 in solid lines and in the position of FIG. 8 in dotted lines.

As best seen in FIG. 10, the hydraulic hoses for supplying motive fluid to the dollys and jacks are shown both nested and in maximum extended position.

What is claimed:

1. An apparatus for removing or replacing a ships underwater propulsion shaft from a ship's hull in a dry dock and transporting it to or from the ship to a work area comprising:

(a) a mobile vehicular frame, (b) spaced apart main cylinder ram lifts pivoted at their base to the vehicular frame, each lying beneath the shaft to be removed, (c) a primary shaft support means mounted on the upper ends of said main cylinder ram lifts, (d) at least a pair of secondary shaft alignment and positioning dolly support means carried by said primary shaft support means and being movable independently of each other along said primary shaft support means for successively maintaining said shaft in axial alignment during removal and replacement of said shaft from the hull to avoid binding of the shaft in the hull support, (e) propulsion shaft receiving means mounted at the upper ends of said secondary shaft dolly support means, (f) variable shaft alignment positioning means between said receiving means and said secondary shaft dolly support means to maintain alignment of the propulsion shaft with the stern tube passing through the ships hull.

2. An apparatus as claimed in claim 1 wherein said primary shaft support means includes a gear track and said secondary shaft support means includes reversible hydraulic motors driving pinions in mesh with the gear rack on the primary support means.

3. An apparatus as claimed in claim 2 wherein the variable shaft positioning means comprises hydraulic jack means between said propulsion shaft receiving means and said secondary shaft support means.

4. An apparatus as claimed in claim 3 wherein there are three secondary shaft dolly support means carried by and driven along said primary shaft support means.

5. An apparatus as claimed in claim 4 further comprising hydraulic control means connected in circuit to raise and lower said shaft alignment and positioning means individually and to control movement of the dolly support means along the primary shaft support individually or together.

6. An apparatus as claimed in claim 1 further comprising hydraulic means for longitudinally shifting said vehicular frame forwardly or rearwardly of the ships major axis are including telescopic hydraulically extensible supports carried by said vehicular frame and having roller support means for said vehicular frame and carrying said hydraulic means for raising and lowering said vehicular frame toward and away from the ship.

7. An apparatus as claimed in claim 6 wherein said hydraulic means for shifting the vehicular frame forwardly or rearwardly are hydraulic jacks secured to the ends of said telescopic hydraulically extensible supports for the vehicle frame.

8. A vehicle mounted apparatus for removing or replacing a ships underwater propulsion shaft from a ship's hull in a dry dock and transporting it from the ship to and from a work area comprising:

a rectangular support, a pair of dolly propulsion shaft support means movable independently of one another along said rectangular support, a gear rack securely positioned on the top of said rectangular support with the teeth directed upwardly, a reversible motor driving a pinion in mesh with said gear rack carried by each dolly, hydraulic jack means mounted on each dolly, propulsion shaft cradle means connected to be raised and lowered by said hydraulic jack means for receiving and supporting the propulsion shaft, dolly and propulsion shaft anti-tilt means carried by said rectangular support positioned to pass over and restrain the propulsion shaft and its support dolly from tilting during transport of the shaft to and from a work area, and hydraulic means connected between said rectangular support and said vehicle for raising and lowering said rectangular support to position said propulsion shaft cradle means in vertical and transverse alignment to remove the propulsion shaft from the ships hull and to re-insert the reworked shaft back into the hull.

9. An apparatus as claimed in claim 8 wherein said dolly propulsion support means are a pair of rubber tired dollies which are driven back and forth along the rectangular support between a pair of spaced apart channel beams having one flange secured to the rectangular support and the other flange overlying the top lateral confines of the dollies.

10. An apparatus as claimed in claim 9 wherein said propulsion shaft cradle means for receiving and supporting the propulsion shaft are blocks having cut-outs complemental to said propulsion shaft.

11. An apparatus as claimed in claim 10 wherein said dolly and propulsion shaft anti-tilt means includes a plurality of chain attachments removably secured to the top flanges of the spaced apart channel beams which are passable over the propulsion shaft when it is nested in the cradle.

* * * * *